US009850751B2

(12) United States Patent
Logan et al.

(10) Patent No.: US 9,850,751 B2
(45) Date of Patent: Dec. 26, 2017

(54) AXIALLY-SUPPORTED DOWNHOLE PROBES

(71) Applicant: EVOLUTION ENGINEERING INC., Calgary (CA)

(72) Inventors: Aaron W. Logan, Calgary (CA); Justin C. Logan, Calgary (CA); David A. Switzer, Calgary (CA); Patrick R. Derkacz, Calgary (CA)

(73) Assignee: Evolution Engineering Inc., Calgary, CA (US)

( * ) Notice: Subject to any disclaimer, the term of this patent is extended or adjusted under 35 U.S.C. 154(b) by 274 days.

(21) Appl. No.: 14/648,955

(22) PCT Filed: Dec. 2, 2013

(86) PCT No.: PCT/CA2013/050925

§ 371 (c)(1),
(2) Date: Jun. 2, 2015

(87) PCT Pub. No.: WO2014/085925

PCT Pub. Date: Jun. 12, 2014

(65) Prior Publication Data

US 2015/0330207 A1 Nov. 19, 2015

Related U.S. Application Data

(60) Provisional application No. 61/732,816, filed on Dec. 3, 2012, provisional application No. 61/882,205, filed on Sep. 25, 2013.

(51) Int. Cl.

| | |
|---|---|
| ***E21B 47/01*** | (2012.01) |
| ***E21B 23/03*** | (2006.01) |
| ***E21B 47/00*** | (2012.01) |
| ***E21B 47/12*** | (2012.01) |

(52) U.S. Cl.
CPC ..... *E21B 47/01* (2013.01); *E21B 23/03* (2013.01); *E21B 47/00* (2013.01); *E21B 47/011* (2013.01); *E21B 47/122* (2013.01)

(58) Field of Classification Search
CPC ..... E21B 47/00; E21B 47/01; E21B 23/03
See application file for complete search history.

(56) References Cited

U.S. PATENT DOCUMENTS

| | | | |
|---|---|---|---|
| 3,149,490 | A | 9/1964 | Clements et al. |
| 3,323,327 | A | 6/1967 | Leathers et al. |

(Continued)

FOREIGN PATENT DOCUMENTS

| | | | |
|---|---|---|---|
| GB | 1434819 | A | 5/1976 |
| WO | 03060283 | A2 | 7/2003 |

(Continued)

*Primary Examiner* — David L Andrews
*Assistant Examiner* — Tara E Schimpf
(74) *Attorney, Agent, or Firm* — Oyen Wiggs Green & Mutala LLP

(57) ABSTRACT

An assembly for use in subsurface drilling includes a downhole probe supported by a locking mechanism with a bore of a drill string section. The probe comprises a first spider and a second spider at the uphole and downhole sections of the probe. The locking mechanism secures the probes in the bore against axial and rotational movement relative the drill string section.

43 Claims, 14 Drawing Sheets

(56) References Cited

U.S. PATENT DOCUMENTS

| | | | | |
|---|---|---|---|---|
| 3,714,831 | A * | 2/1973 | Quichaud | E21B 47/011 175/40 |
| 4,571,215 | A | 2/1986 | Hansen | |
| 4,684,946 | A | 8/1987 | Issenmann | |
| 4,938,299 | A | 7/1990 | Jelsma | |
| 5,236,048 | A | 8/1993 | Skinner et al. | |
| 5,247,990 | A | 9/1993 | Sudol et al. | |
| 5,474,132 | A | 12/1995 | Gallagher | |
| 5,520,246 | A | 5/1996 | Van Steenwyk et al. | |
| 6,026,915 | A | 2/2000 | Smith et al. | |
| 6,429,653 | B1 | 8/2002 | Kruspe et al. | |
| 6,446,736 | B1 | 9/2002 | Kruspe et al. | |
| 6,750,783 | B2 | 6/2004 | Rodney | |
| 6,761,230 | B2 * | 7/2004 | Cross | E21B 47/022 175/40 |
| 7,151,466 | B2 | 12/2006 | Gabelmann et al. | |
| 7,243,028 | B2 | 7/2007 | Young et al. | |
| 7,600,582 | B2 | 10/2009 | Wright, Jr. et al. | |
| 2005/0217898 | A1 | 10/2005 | Clark | |
| 2007/0235224 | A1 | 10/2007 | Koger | |
| 2008/0314585 | A1 * | 12/2008 | Clark | E21B 17/1007 166/250.17 |
| 2009/0023502 | A1 | 1/2009 | Koger | |
| 2013/0140087 | A1 | 6/2013 | Koch et al. | |
| 2013/0153207 | A1 * | 6/2013 | Lauderdale | E21B 23/02 166/123 |

FOREIGN PATENT DOCUMENTS

| | | | |
|---|---|---|---|
| WO | 2006083764 | A1 | 8/2006 |
| WO | 2008116077 | A2 | 9/2008 |
| WO | 2012045698 | A1 | 4/2012 |
| WO | 2012082748 | A2 | 6/2012 |

* cited by examiner

AXIALLY-SUPPORTED DOWNHOLE PROBES

CROSS REFERENCE TO RELATED APPLICATIONS

This application claims priority from U.S. Application No. 61/732,816 filed 3 Dec. 2012 and U.S. Application No. 61/882,205 filed 25 Sep. 2013. For purposes of the United States, this application claims the benefit under 35 U.S.C. §119 of U.S. Application No. 61/732,816 filed 3 Dec. 2012 and U.S. Application No. 61/882,205 filed 25 Sep. 2013, both of which are entitled AXIALLY-SUPPORTED DOWNHOLE PROBES and both of which are hereby incorporated herein by reference for all purposes.

TECHNICAL FIELD

This application relates to subsurface drilling, specifically to downhole probes. Embodiments are applicable to drilling wells for recovering hydrocarbons.

BACKGROUND

Recovering hydrocarbons from subterranean zones relies on drilling wellbores.

Wellbores are made using surface-located drilling equipment which drives a drill string that eventually extends from the surface equipment to the formation or subterranean zone of interest. The drill string can extend thousands of feet or meters below the surface. The terminal end of the drill string includes a drill bit for drilling (or extending) the wellbore. Drilling fluid usually in the form of a drilling "mud" is typically pumped through the drill string. The drilling fluid cools and lubricates the drill bit and also carries cuttings back to the surface. Drilling fluid may also be used to help control bottom hole pressure to inhibit hydrocarbon influx from the formation into the wellbore and potential blow out at surface.

Bottom hole assembly (BHA) is the name given to the equipment at the terminal end of a drill string. In addition to a drill bit a BHA may comprise elements such as: apparatus for steering the direction of the drilling (e.g. a steerable downhole mud motor or rotary steerable system); probes for measuring properties of the surrounding geological formations (e.g. probes for use in well logging); probes for measuring downhole conditions as drilling progresses; systems for telemetry of data to the surface; stabilizers; drill collars, pulsers and the like. The BHA is typically advanced into the wellbore by a string of metallic tubulars (drill pipe).

A downhole probe may comprise any active mechanical, electronic, and/or electromechanical system that operates downhole. A probe may provide any of a wide range of functions including, without limitation, data acquisition, measuring properties of the surrounding geological formations (e.g. well logging), measuring downhole conditions as drilling progresses, controlling downhole equipment, monitoring status of downhole equipment, measuring properties of downhole fluids and the like. A probe may comprise one or more systems for: telemetry of data to the surface; collecting data by way of sensors (e.g. sensors for use in well logging) that may include one or more of vibration sensors, magnetometers, inclinometers, accelerometers, nuclear particle detectors, electromagnetic detectors, acoustic detectors, and others; acquiring images; measuring fluid flow; determining directions; emitting signals, particles or fields for detection by other devices; interfacing to other downhole equipment; sampling downhole fluids, etc. Some downhole probes are highly specialized and expensive.

Downhole conditions can be harsh. Exposure to these harsh conditions, which can include high temperatures, vibrations, turbulence and pulsations in the flow of drilling fluid past the probe, shocks, and immersion in various drilling fluids at high pressures can shorten the lifespan of downhole probes and increase the probability that a downhole probe will fail in use. Supporting and protecting downhole probes is important as a downhole probe may be subjected to high pressures (20,000 p.s.i. or more in some cases), along with severe shocks and vibrations. Replacing a downhole probe that fails while drilling can involve very great expense.

An example application of downhole probes is steering the direction of drilling in directional drilling. In some directional drilling applications the inclination and compass heading of the hole is continuously measured by systems in a downhole probe. Course corrections may be made based on information provided by the downhole probe. An example directional drilling system includes a mud motor drilling system in which a mud motor is powered by the flow of drilling fluid to operate the drill. In such systems the drill may be steered using a "bent sub" located near the drill bit. The bent sub causes the drill to address formations at an angle to the longitudinal axis of the drill string. The drill string can be turned to change the angle at which the drill engages the formation being drilled into. The drill may be steered by turning the drill string as drilling progresses to cause the wellbore to follow a desired trajectory.

A downhole probe may include instrumentation that determines the orientation of the downhole probe. Information from such instrumentation in the downhole probe may be used to make decisions regarding how to steer the drill. In such systems the offset angle of the bent sub relative to the downhole probe may be measured and taken into account in interpreting information from the downhole probe.

A downhole probe may communicate a wide range of information to the surface by telemetry. Telemetry information can be invaluable for efficient drilling operations. For example, telemetry information may be used by a drill rig crew to make decisions about controlling and steering the drill bit to optimize the drilling speed and trajectory based on numerous factors, including legal boundaries, locations of existing wells, formation properties, hydrocarbon size and location, etc. A crew may make intentional deviations from the planned path as necessary based on information gathered from downhole sensors and transmitted to the surface by telemetry during the drilling process. The ability to obtain and transmit reliable data from downhole locations allows for relatively more economical and more efficient drilling operations.

Various techniques have been used to transmit information from a location in a bore hole to the surface. These include transmitting information by generating vibrations in fluid in the bore hole (e.g. acoustic telemetry or mud pulse telemetry) and transmitting information by way of electromagnetic signals that propagate at least in part through the earth (EM telemetry). Other telemetry systems use hardwired drill pipe, fibre optic cable, or drill collar acoustic telemetry to carry data to the surface.

Sensors for use in directional drilling are typically located in a downhole probe or instrumentation assembly suspended in a bore of a drill string near the drill bit. The probe is typically suspended within the bore of a drill collar. As it is secured uphole, the probe is subject to the fluid initiated harmonics and torsional acceleration events from stick slip which can lead to side-to-side and/or torsional movement of the probe. This can result in damage to the electronics and sensors in the probe or sections of the housing of the probe can come unthreaded from each other.

The following references describe various centralizers that may be useful for supporting a downhole electronics probe centrally in a bore within a drill string. The following is a list of some such references: US2007/0235224; US2005/0217898; U.S. Pat. No. 6,429,653; U.S. Pat. No. 3,323,327; U.S. Pat. No. 4,571,215; U.S. Pat. No. 4,684,946; U.S. Pat. No. 4,938,299; U.S. Pat. No. 5,236,048; U.S. Pat. No. 5,247,990; U.S. Pat. No. 5,474,132; U.S. Pat. No. 5,520,246; U.S. Pat. No. 6,429,653; U.S. Pat. No. 6,446,736; U.S. Pat. No. 6,750,783; U.S. Pat. No. 7,151,466; U.S. Pat. No. 7,243,028; US2009/0023502; WO2006/083764; WO2008/116077; WO2012/045698; and WO2012/082748.

There remains a need for ways to support downhole probes in a way that provides improved protection against mechanical shocks and vibrations and other downhole conditions.

SUMMARY

This invention has a variety of aspects. These include, without limitation, downhole probes, downhole apparatus that includes downhole probes supported within a drill string, methods for supporting downhole probes, methods for assembling downhole probes and other related methods and apparatus.

An aspect of the invention provides a downhole assembly comprising: a drill string section having a bore extending longitudinally through the drill string section and a downhole probe located in the bore of the section. The probe is supported in the bore by first and second spiders spaced apart longitudinally within the bore. At least one of the first and second spiders abuts a landing step in the bore. In some embodiments at least one of the first and second spiders is coupled non-rotationally to the probe and to the drill string section.

In some embodiments, both spiders are axially fixed, for example, by abutting landings in the bore. A nut, a clamp or other means may be provided to clamp one of the spiders against a corresponding landing. In some embodiments the probe and landings are dimensioned such that a section of the probe is axially compressed in clamping the spider towards its landing.

Another aspect provides a downhole assembly comprising a drill string section having a bore extending longitudinally through the drill string section and a downhole probe located in the bore of the section. The downhole probe is supported in the bore by first and second supports spaced apart longitudinally within the bore. Each of the first and second supports holds the downhole probe against axial movement in the bore. One or both of the supports may optionally hold the downhole probe against rotation in the bore. In some embodiments, one of the supports comprises a spider coupled to the downhole probe and engaged against a landing in the bore. In some embodiments the downhole probe comprises a plurality of sections coupled together at one or more couplings located between the first and second supports.

In some embodiments, one of the supports comprises a landing in the bore and a clamping member arranged to clamp a member extending from the probe against the landing. The probe may be dimensioned such that clamping the member against the landing axially compresses the probe between the first and second supports.

Further aspects of the invention and features of example embodiments are illustrated in the accompanying drawings and/or described in the following description.

BRIEF DESCRIPTION OF THE DRAWINGS

The accompanying drawings illustrate non-limiting example embodiments of the invention.

DESCRIPTION

Figure 1:
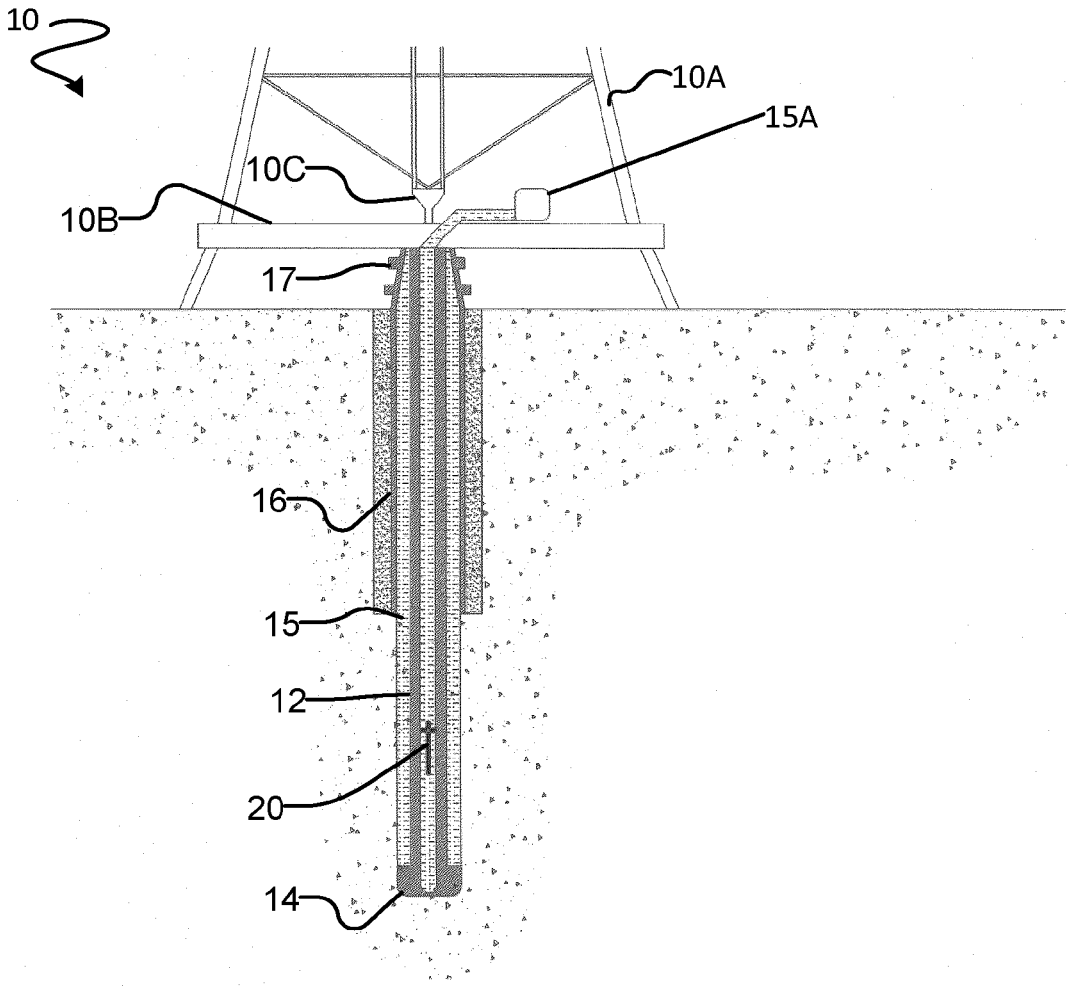
FIG. 1 is a schematic view of a drilling operation.

FIG. 1 shows schematically an example drilling operation. A drill rig 10 drives a drill string 12 which includes sections of drill pipe that extend to a drill bit 14. The illustrated drill rig 10 includes a derrick 10A, a rig floor 10B and draw works 10C for supporting the drill string. Drill bit 14 is larger in diameter than the drill string above the drill bit. An annular region 15 surrounding the drill string is typically filled with drilling fluid. The drilling fluid is pumped by a pump 15A through a bore in the drill string to the drill bit and returns to the surface through annular region 15 carrying cuttings from the drilling operation. As the well is drilled, a casing 16 may be made in the well bore. A blow out preventer 17 is supported at a top end of the casing. The drill rig illustrated in FIG. 1 is an example only. The methods and apparatus described herein are not specific to any particular type of drill rig.

Drill string 12 includes a downhole probe 20. Here the term 'probe' encompasses any active mechanical, electronic, and/or electromechanical system. Probe 20 may provide any of a wide range of functions including, without limitation, data acquisition, measuring properties of the surrounding geological formations (e.g. well logging), measuring downhole conditions as drilling progresses, controlling downhole equipment, monitoring status of downhole equipment, measuring properties of downhole fluids and the like. Probe 20 may comprise one or more systems for: telemetry of data to the surface; supplying electrical power for other probe systems; receiving data from the surface; collecting data by way of sensors (e.g. sensors for use in well logging) that may include one or more of vibration sensors, magnetometers, inclinometers, accelerometers, nuclear particle detectors, electromagnetic detectors, acoustic detectors, and others; acquiring images; measuring fluid flow; determining directions; emitting signals, particles or fields for detection by other devices; interfacing to other downhole equipment; sampling downhole fluids, etc. Probe 20 may be located anywhere along drill string 12 (although as noted above, in many applications, probe 20 will be located in the bore of a BHA).

The following description describes an electronics package 22 which is one example of a downhole probe. Electronics package 22 comprises a housing enclosing electric circuits and components providing desired functions. However, the probe is not limited to electronics packages and, in some embodiments, could comprise mechanical or other non-electronic systems. In any of the embodiments described below electronics package 22 may be replaced with any other downhole probe.

The housing of electronics package 22 typically comprises an elongated cylindrical body that contains within it electronic systems or other active components of the downhole probe. The body may, for example, comprise a metal tube designed to withstand downhole conditions. The body may, for example, have a length in the range of 1 to 20 meters. The body, for example, may comprise several sections joined to each other, for example, by threaded couplings. In some embodiments the body has a plurality of electrically-conductive sections that are electrically insulated from one another. These sections may serve as terminals connecting electronics inside the body to external conductors.

In some embodiments, different electrically-conductive sections of the body of electronics package 22 are coupled to drill string sections that are electrically insulated from one another (e.g. to different ends of a gap sub assembly). Electrical connections between body 22 and adjacent parts of the drill string may be made by way of spiders as described below, for example.

Downhole electronics package 22 may optionally include a telemetry system for communicating information to the surface in any suitable manner. In some example embodiments a telemetry system is an electromagnetic (EM) telemetry system however, where telemetry is provided, other modes of telemetry may be provided instead of or in addition to EM telemetry.

Embodiments of the present invention provide downhole probes and associated support apparatus that constrain motions of downhole probes and parts thereof. Such embodiments may provide one or more of the following features: axial constraint of a probe at two or more locations spaced apart axially along the probe; and non-rotational mounting of the probe in a bore of a drill string.

Figure 2:
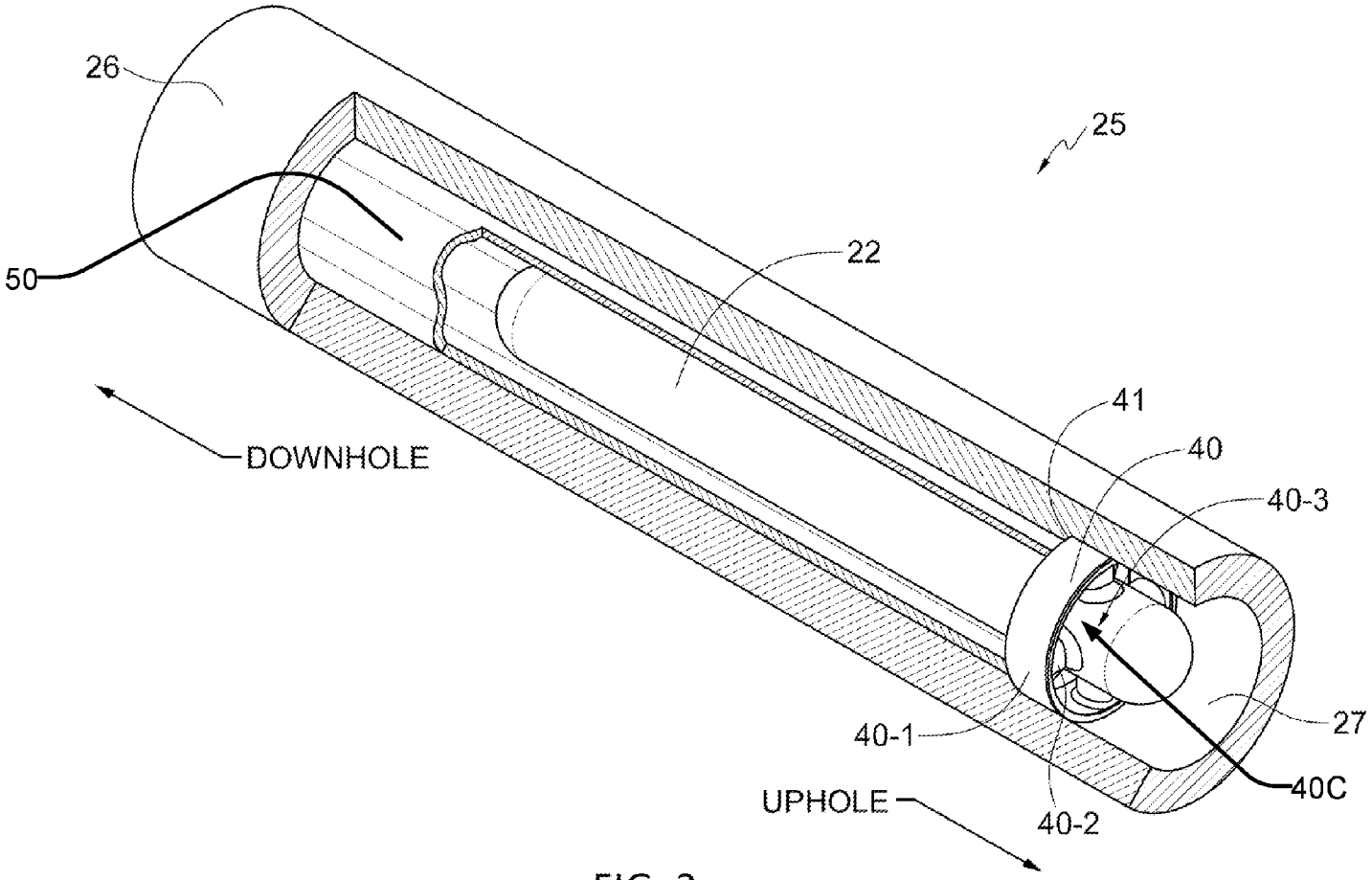
FIG. 2 is a perspective cutaway view of a downhole probe containing an electronics package.
Figure 2A:
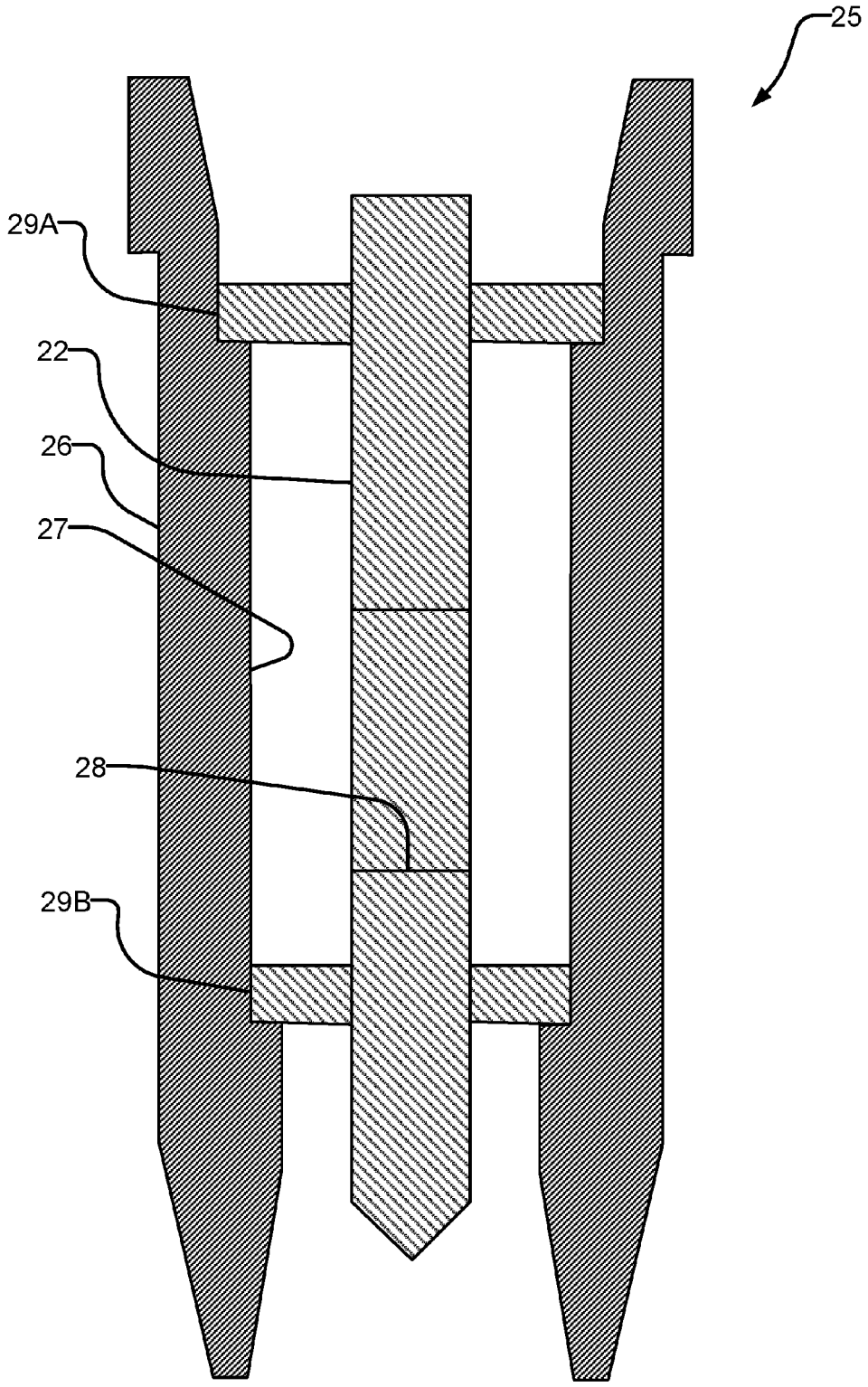
FIG. 2A shows schematically a drill collar having a downhole probe mounted within a bore of the drill collar.

FIGS. 2 and 2A show example downhole assemblies 25. Downhole assembly 25 comprises an electronics package 22 supported within a bore 27 in a section 26 of drill string. Section 26 may, for example, comprise a drill collar or the like. Section 26 may comprise a single component or a number of components that are coupled together and are designed to allow section 26 to be disassembled into its component parts if desired. For example, section 26 may comprise a plurality of collars coupled together by threaded or other couplings.

Electronics package 22 is smaller in diameter than bore 27 such that there is space for drilling fluid to flow past electronics package 22 within bore 27. Electronics package 22 is locked against axial movement within bore 27 at two spaced-apart locations 29A and 29B. Electronics package 22 may be axially supported at locations 29A and 29B in any suitable manner. For example, axial restraint may be provided by way of pins, bolts, clamps, or other suitable fasteners. Restriction against axial movement of electronics package 22 at spaced apart locations 29A and 29B prevents parts of the body of electronics package 22 from becoming loose or disconnected at connections 28 (which may, for example, comprise couplings that are configured to move axially when disconnected—for example, couplings 28 may comprise threaded couplings, push-together couplings or the like).

The axial support mechanisms may additionally hold electronics package 22 at a desired location within bore 27. For example, the axial supports may hold electronics package 22 centralized in bore 27 such that the longitudinal centerlines of electronics package 22 and section 26 are aligned with one another. In the illustrated embodiments, the axial supports comprise spiders that also rigidly hold electronics package 22 against radial motion within bore 27.

FIG. 2 shows an example of an axial support mechanism. In the embodiment illustrated in FIG. 2, a spider 40 having a rim 40-1 supported by arms 40-2 is attached to electronics package 22. Rim 40-1 engages a landing comprising a ledge or step 41 formed at the end of a counterbore within bore 27. Rim 40-1 is clamped tightly against ledge 41 by a nut 44 (see FIG. 3A) that engages internal threads on surface 42.

Figure 3:
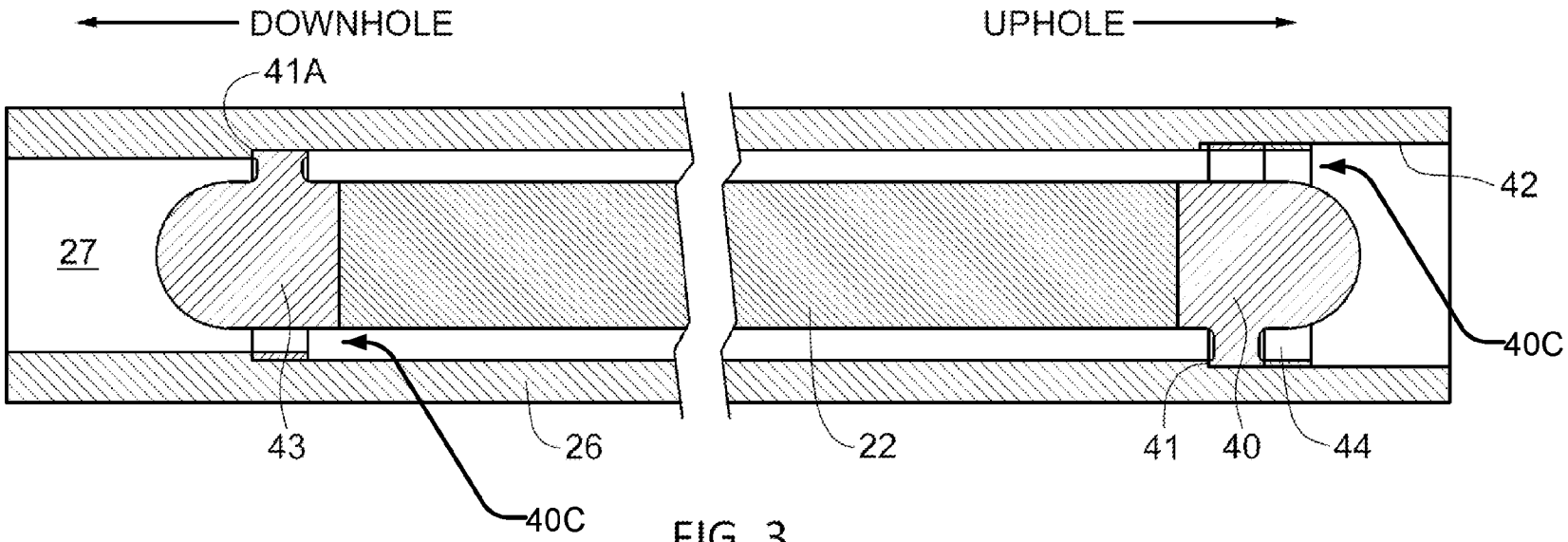
FIG. 3 is a schematic illustration of one embodiment of the present disclosure where an electronics package is supported between two spiders.
Figure 3A:
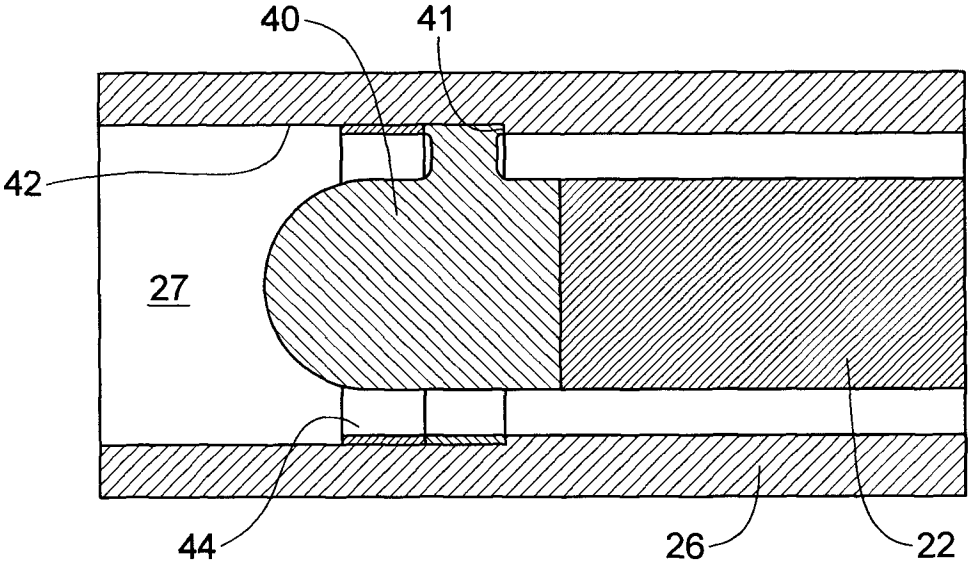
FIG. 3A is a detail showing one assembly for anchoring a downhole probe against longitudinal movement.

In an example embodiment shown in FIG. 3, electronics package 22 is supported between two spaced-apart landing spiders 40 and 43. Landing spiders 40 and 43 are respectively located near the uphole and downhole ends of electronics package 22. Uphole landing spider 40 and downhole landing spider 43 may be sized to abut different landing ledge sizes within section 26. Landing spiders 40 and 43 engage landing ledges 41 and 41A, respectively, within bore 27. Landing spiders 40 and 43 provide apertures 40C through which drilling fluid can flow. It is not mandatory that both landing spiders 40 and 43 engage a landing (such as ledge 41 or 41A). In some alternative embodiments one of the landing spiders 40 and 43 is able to float axially within bore 27.

Landing spiders 40 and 43 may be made from materials suitable for use in downhole environments such as, by way of non-limiting example, beryllium copper, stainless steels and the like.

A centralizer 50 may be provided between spiders 40 and 43 in order to concentrically support the probe within section 26. Optionally spiders 40 and 43 are each spaced longitudinally apart from the ends of the centralizer by a short distance (e.g. up to about ½ meter (18 inches) or so) to encourage laminar flow of drilling fluid past electronics package 22. The centralizer may take different shapes and/or sizes and may be constructed from material different from or similar to the interior of section 26. In addition, there may be more than one centralizer to concentrically support the different parts of electronics package 22 between landing spiders 40 and 43.

In some embodiments electronics package 22 has a fixed rotational orientation relative to section 26. Such non-rotational support of electronics package 22 in bore 27 can be beneficial for one or more of: keeping sensors in electronics package 22 in a desired angular orientation relative to section 26 and other parts of the drill string; inhibiting torsional vibration modes of electronics package 22; and inhibiting unintentional uncoupling of any couplings in electronics package 22 that rotate as they are uncoupled. In an example embodiment, such non-rotational coupling is provided by configuring one or both of spiders 40 and/or 43 to be non-rotationally coupled to both electronics package 22 and bore 27. In practice it is most convenient for one of spiders 40 and 43 to be free to rotate at least somewhat relative to bore 27 during installation to facilitate the easy installation of electronics package 22 into bore 27. In some such embodiments, the spider that is free to rotate at least somewhat relative to bore 27 during installation is clamped against a landing shoulder during installation with the result that it too is inhibited from rotating significantly relative to section 26 after installation.

Figure 3B:
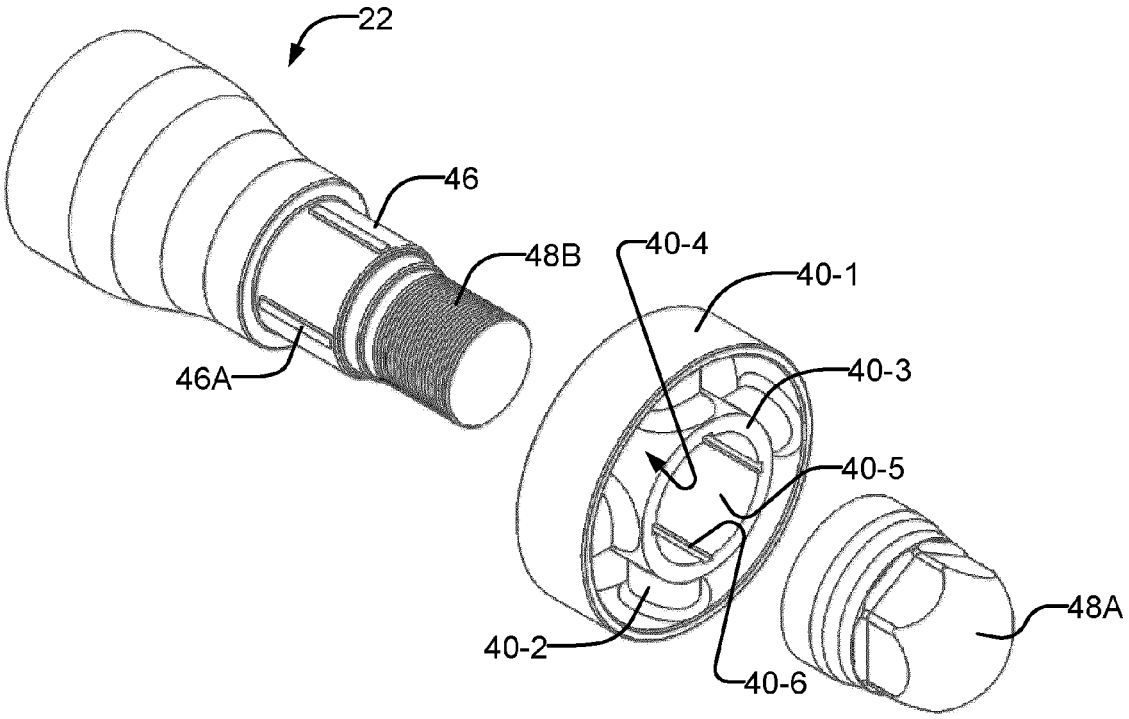
FIG. 3B is a detail showing one way to attach a spider to an electronics package or other probe.

FIG. 3B shows an example of how a spider may be coupled to a downhole electronics package or other probe. As shown in FIG. 3B, a spider 40 has a rim 40-1 supported by arms 40-2 which extend to a hub 40-3 attached to downhole probe 22. Openings 40-4 between arms 40-2 provide space for the flow of drilling fluid past the spider 40.

In some embodiments hub 40-3 of spider 40 is keyed, splined, has a shaped bore that engages a shaped shaft on electronics package 22 or is otherwise non-rotationally mounted to electronics package 22. In the example embodiment shown in FIG. 3B, electronics package 22 comprises a shaft 46 dimensioned to engage a bore 40-5 in hub 40-3 of spider 40. A nut 48A engages threads 48B to secure spider 40 on shaft 46. In the illustrated embodiment, shaft 46 comprises splines 46A which engage corresponding grooves 40-6 in bore 40-5 to prevent rotation of spider 40 relative to shaft 46. Splines 46A may be asymmetrical such that spider 40 can be received on shaft 46 in only one orientation. An opposing end of downhole electronics package 22 (not shown in FIG. 3B) may be similarly configured to support another spider 40.

Spider 40 may also be non-rotationally mounted to section 26, for example by way of a key, splines, shaping of the face or edge of rim 40A that engages corresponding shaping within bore 27 or the like. More than one key may be provided to increase the shear area and resist torsional movement of electronics package 22 within bore 27 of section 26. In some embodiments one or more keyways, splines or the like for engaging spider 40 are provided on a member that is press-fit, pinned, welded, bolted or otherwise assembled to bore 27. In some embodiments the member comprises a ring bearing such features.

Nut 48A may include features to minimize undesirable properties of drilling fluid flow (e.g. turbulence and recirculation). Nut 48A may be an acorn nut with a rounded cap. Nut 48A may have a smaller diameter than electronics package 22. Nut 48A may have a diameter which tapers to match the diameter of electronics package 22. A smaller diameter of nut 48A may provide a larger flow area for drilling fluid. Nut 48A may be dimensioned such that it can be loosened or tightened with a standard wrench.

A washer (not shown) may be provided between nut 48A and spider 40. The washer may have properties which make the connection of nut 48A more reliable (e.g. less likely to loosen during drilling). The washer may be a Nord-Lock® washer, or a plurality of Nord-Lock® washers, for example.

Figure 3C:
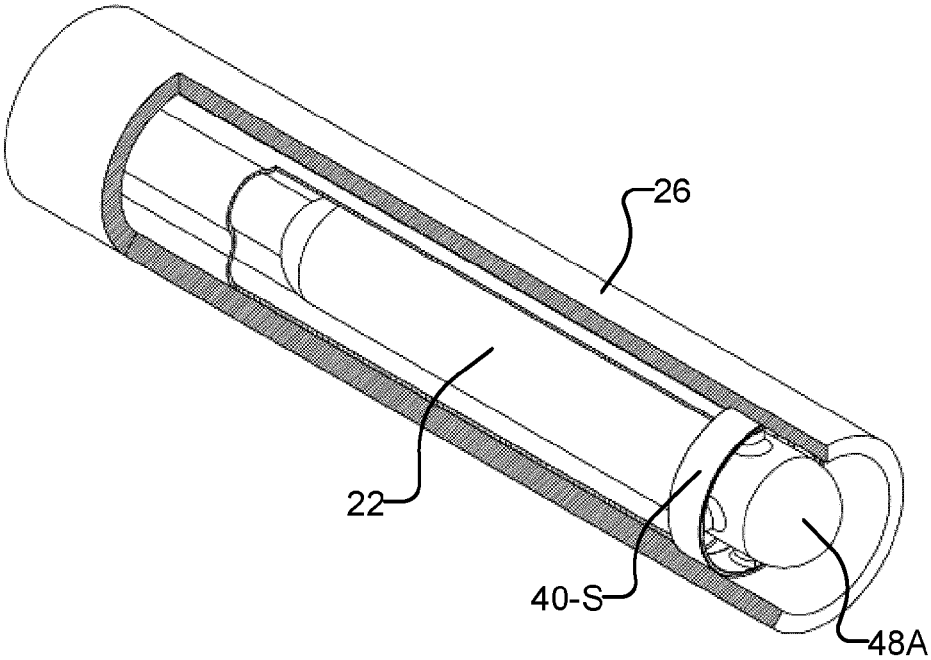
FIGS. 3C and 3D show the same electronics package with spiders of different sizes.
Figure 3D:
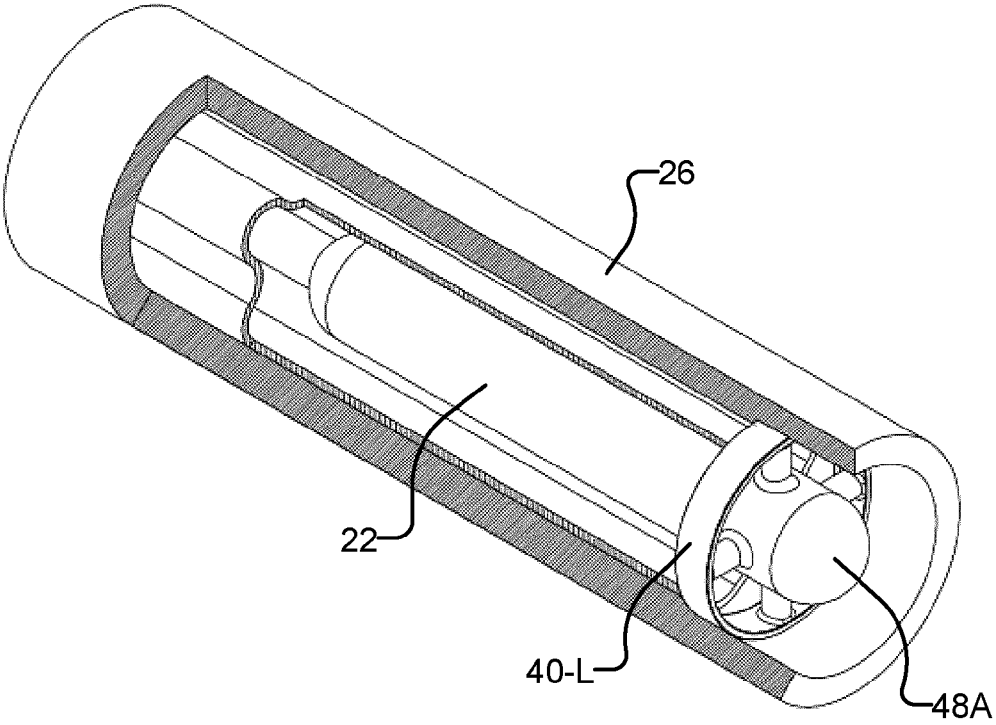

Electronics package 22 may be used with spiders of different sizes. FIG. 3C shows a small spider 40-S attached to electronics package 22 and FIG. 3D shows a large spider 40-L attached to electronics package 22. Spider 40-S has a smaller diameter than spider 40-L, but both spiders are dimensioned to attach to the same shaft 46 of electronics package 22. The same nut 48A may be used to attach electronics package 22 to either one of spiders 40-S and 40-L.

Electronics package 22 can be used in a bore of a given size by using a spider with an appropriate diameter. A set of spiders of different diameters may be provided with electronics package 22 so that electronics package 22 may be used within bores of different sizes.

Spiders may be attached to and removed from electronics package 22 without exposing any of the internal components of electronics package 22. Electronics package 22 may remain entirely sealed when nut 48A and spider 40 are removed. By reducing the exposure of the internal component of electronics package 22 to the environment, the longevity and reliability of electronics package 22 may be increased.

Spider 40 may be made of a conductive material. Spider 40 may act as an electrically conductive path between electronics package 22 and section 26. This may enhance the operation of electromagnetic telemetry.

In some embodiments a downhole electronics package 22 has spiders at each end. Advantageously, one of the spiders may be configured to non-rotationally engage both the electronics package 22 and section 26. The other spider may be configured to be rotatable with respect to at least one of the electronics package 22 and section 26. In some embodiments the spider that is configured to non-rotationally engage both the electronics package 22 and section 26 is free to float axially in bore 27 (for example to accommodate thermal expansion and contraction of electronics package 22 with changes in temperature).

Figure 4:
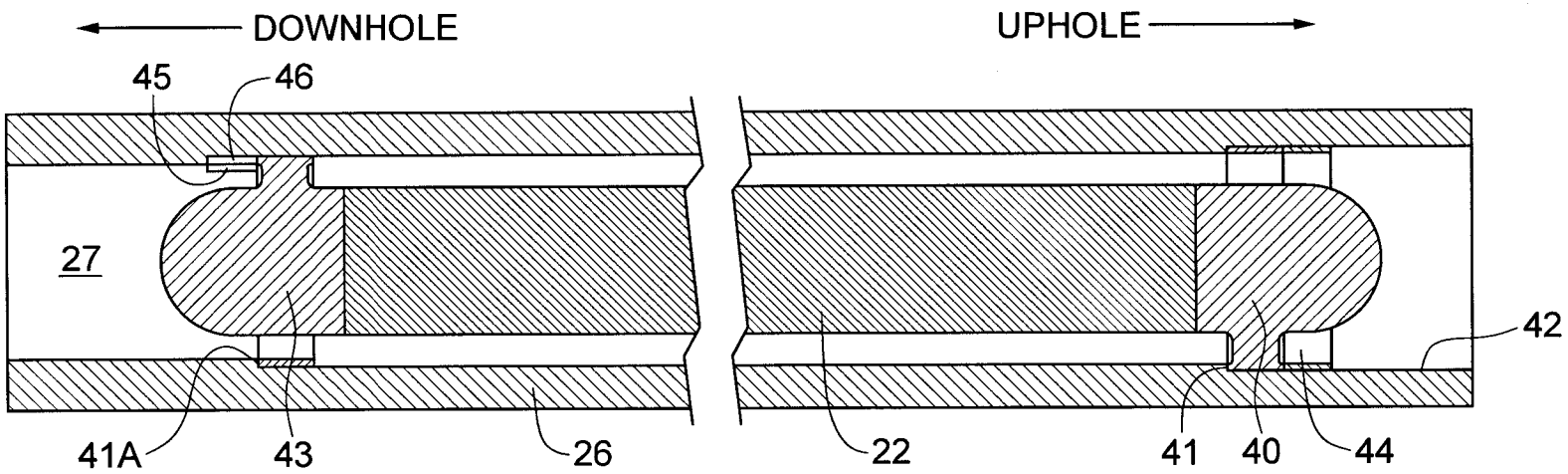
FIG. 4 is a schematic illustration of another embodiment of the invention where an electronics package is supported between two spiders.

In an example embodiment shown in FIG. 4, a key 45 is connected to landing spider 43. Key 45 engages a keyway 46 on the internal surface of section 26. Key 45 provides torsional structural support for electronics package 22 within section 26.

It can be seen that in the FIG. 4 embodiment, key 45 and nut 44 respectively secure electronics package 22 against rotational and axial movement within section 26. Frictional engagement between spider 40 and landing 41 and/or nut 44 may further hold electronics package 22 against rotation relative to section 26. These features therefore hold electronics package 22 to move as a unit with section 26.

In some embodiments, electronics package 22 is supported by two or more spiders but only one of the spiders engages a landing ledge in bore 27. Another spider may be free to float axially in bore 27. In some such embodiments the landing spider that is free to float axially may be constrained against rotating in bore 27 by a key or the like. Again, such embodiments hold electronics package 22 both axially and rotationally in bore 27 of section 26. In embodiments wherein one of two spiders engages a landing ledge, the landing ledge may be located and dimensioned to accept either one of the spiders (e.g. an uphole spider or a downhole spider).

Under downhole conditions, section 26 and electronics package 22 may undergo different amounts of thermal expansion. For example, electronics package 22 may expand slightly more than section 26. Allowing one spider or other support member to float axially in bore 27 can assist in accommodating thermal expansion of electronics package 22. For example, in an embodiment where an uphole spider is clamped against an uphole landing ledge and a downhole spider can float axially, the downhole spider (and a downhole key 45 if present) may be able to travel axially along key channel 46 allowing for thermal expansion of electronics package 22. By way of non-limiting example, key 45 may have the freedom to move axially by at least ±0.075 inch or so.

In the example embodiment shown in FIG. 3, the length of electronics package 22 matches the distance between landing ledges 41 and 41A. In this embodiment, landing spiders 40 and 43 engage landing ledges 41 and 41A, respectively, and nut 44 may be used to secure landing spider 40 by engaging internal threads on surface 42. Thus nut 44 secures electronics package 22 against axial movement within section 26.

In some embodiments, electronics package 22 is supported axially at two axially-spaced apart locations and electronics package 22 has one or more couplings that connect together different sections of electronics package 22 between the axial support locations. The couplings may, for example, comprise threaded couplings. In such embodiments, the axial supports can both prevent axial movement of electronics package 22 and limit or prevent axial elongation of electronics package 22. This, in turn can act to prevent unintentional uncoupling of the one or more couplings.

In embodiments where electronics package 22 is supported against axial movement at two spaced-apart locations (e.g. in a case where two landing ledges are provided and each lands a corresponding support for electronics package 22) the supports may optionally be spaced apart in such a way that electronics package 22 is placed into compression when the support features are each bearing against the corresponding landing ledge. For example, electronics package 22 may be dimensioned such that bearing faces of the support features (e.g. spiders) are spaced apart by a distance that is somewhat greater than a spacing of the landing ledges along section 26. In such embodiments a nut or other fastening may be tightened to first bring a support feature (such as a spider) remote from the nut against its landing ledge. The nut may then be further tightened to compress the electronics package axially until the support feature closest to the nut is brought against its landing ledge.

In an embodiment where electronics package 22 is maintained under axial compression, thermal expansion of electronics package 22 may increase the compression.

Axial compression of electronics package 22 can advantageously assist in one or more of: preventing couplings in electronics package 22 from opening up, damping vibrations of electronics package 22, altering resonant frequencies of some vibrational modes of electronics package 22 (and thereby making such vibrational modes less likely to be excited by low-frequency vibrations from drilling); and providing a load on nut 44 which helps to inhibit nut 44 or other clamping mechanism from loosening when exposed to vibrations.

Figure 5:
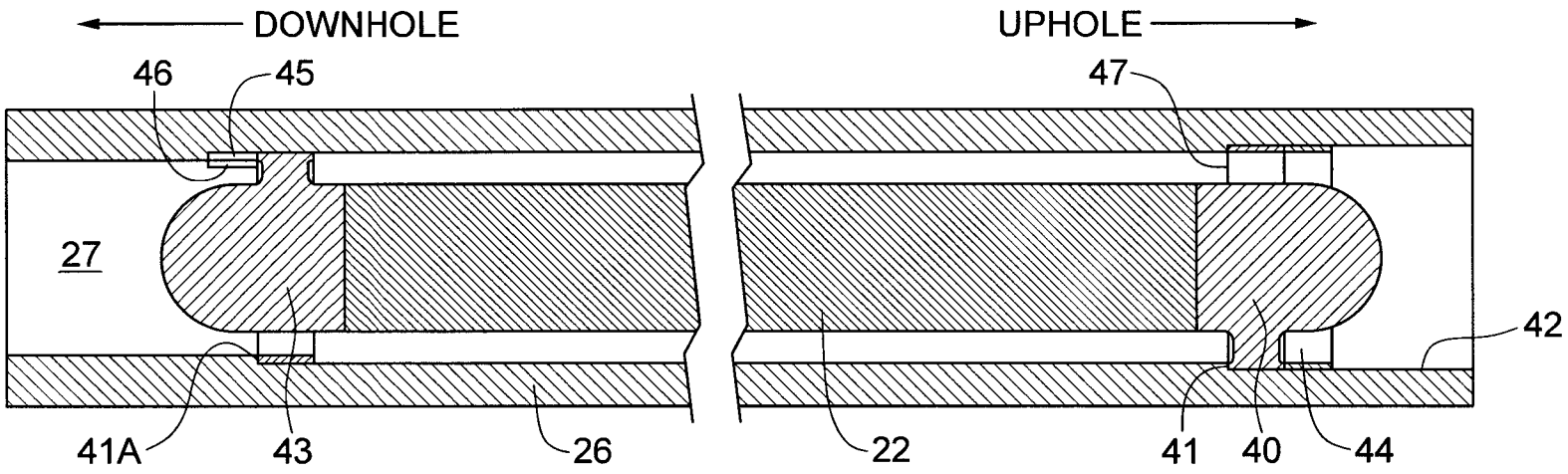
FIG. 5 is a schematic illustration of another embodiment of the present invention where an electronics package is supported between two spiders.

In the example embodiment as shown in FIG. 5, electronics package 22 is dimensioned such that the distance between landing surfaces of landing spiders 40 and 43 is slightly greater than the distance between landing ledges 41 and 41A. In such an embodiment, when downhole landing spider 43 is slid into bore 27 until it engages landing ledge 41A, uphole landing spider 40 is axially spaced apart from its landing ledge 41 by clearance gap 47. Nut 44 (or an alternative clamping mechanism) may then be tightened to move the rim of landing spider 40 into contact with landing ledge 41. As nut 44 is tightened, clearance gap 47 is reduced. In some embodiments, nut 44 may be tightened until it compresses the rim of landing spider 40 against landing ledge 41. The initial dimensions of clearance gap 47 may be varied. However, in some non-limiting example embodiments, clearance gap 47 is a few hundredths of an inch (e.g. in the range of about 0.010 inches to about 0.030 inches). A typical value of the compression of electronics package 22 is around 0.015 inches.

Axial compression of electronics package 22 results in electronics package 22 becoming somewhat shorter such that clearance gap 47 is taken up. Axial compression applied, for example, by nut 44 may take up slack in couplings which couple-together different parts of electronics package 22 and also resiliently compress the structural parts of electronics package 22.

Figure 8:
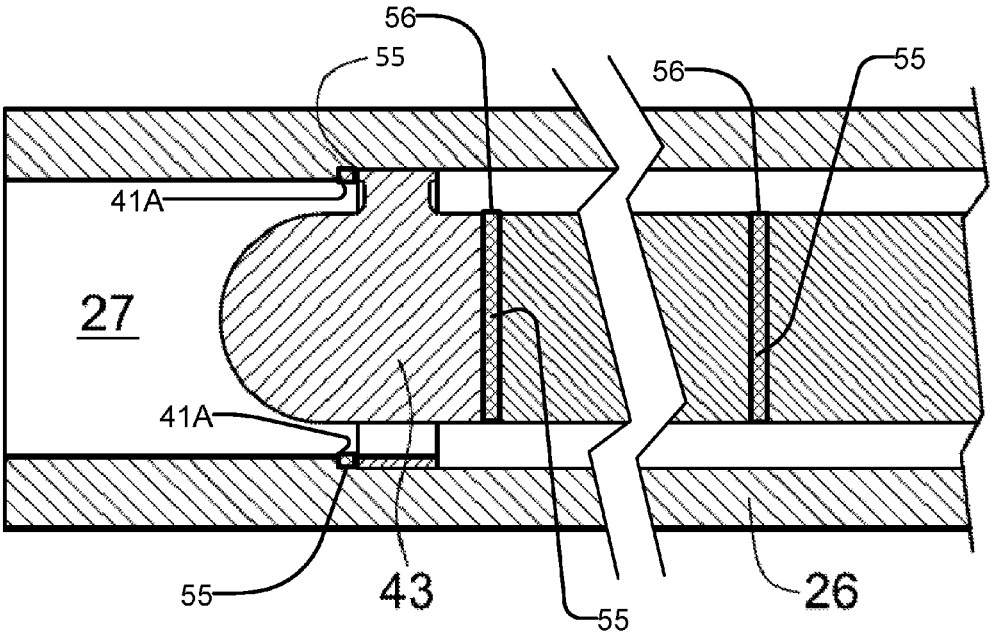
FIG. 8 is a schematic illustration showing compliant materials built into and/or used to support an electronics package.

In some embodiments (see FIG. 8), compliant materials 55 are built into electronics package 22 and/or used to support electronics package 22. The compliant materials may become compressed as electronics package 22 is axially compressed. For example, compressible washers 56 may be added between sections of electronics package 22 and/or between spiders 40 and/or 43 and bearing surfaces of electronics package 22 to increase the compressive ability of electronics package 22. As another example, one or both of landing spiders 40 and 43 may act like springs. For example arms 40B may deflect in an axial direction (axial relative to the longitudinal axis of electronics package 22) in response to axial compression applied to the rim of spider 40. As another example, landing ledge 41A may be faced with a resilient material such as an elastomer gasket or the like. One or more such compliant structures may be provided. Where such compliant structures are provided then clearance gap 47 may be increased. Such compliant structures may comprise rubber, suitable elastomers, or the like. In alternative embodiments the compliant structures may comprise single-use structures that can be crushed under the axial compression exerted by nut 44 (or other clamping mechanism).

Clearance gap 47 is selected such that the axial compression on electronics package 22 will be insufficient to cause failure of electronics package 22 by buckling or other structural failure mechanism. For example, clearance gap 47 may be selected such that the maximum axial force on electronics package 22 does not exceed a threshold percentage of the force required to buckle electronics package 22 under downhole conditions. The percentage may, for example, be 50% or 65%.

In some embodiments, clearance gap 47 may be very large and/or there may not be a landing ledge for spider 40. In such embodiments, tightening of nut 44 may simply compress electronics package 22 axially and press landing spider 43 against its landing ledge 41A. Such embodiments are not preferred because they do not protect against overcompression of electronics package 22.

Axial compression of electronics package 22 may be sufficient such that the forces applied between spiders 40 and 43 and the corresponding surfaces of nut 44 and landing ledge 41A are sufficiently large that there is enough friction between spiders 40 and 43 and the surfaces that bear against them to prevent electronics package 22 from rotating in bore 27 under normally encountered downhole conditions. In such embodiments, features that positively limit rotation of spiders 40 or 43 (such as keys 45 and associated keyways) may be unnecessary.

Figure 6:
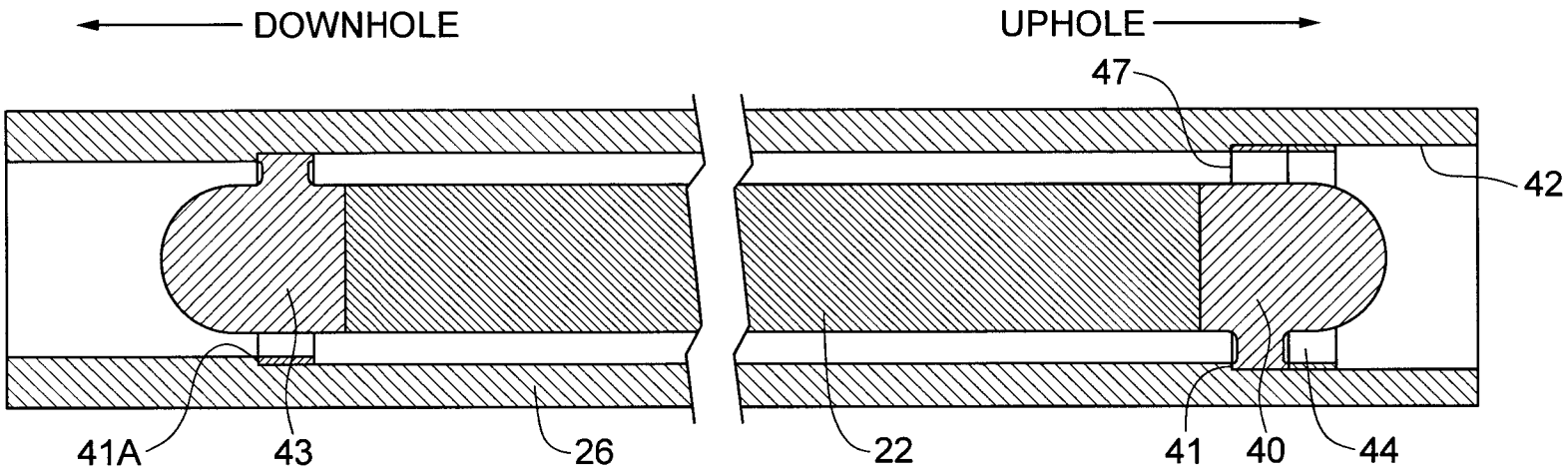
FIG. 6 is a schematic illustration of another embodiment of the present invention where an electronics package is supported between two spiders.

In an example embodiment shown in FIG. 6, electronics package 22 is supported between landing spiders 40 and 43. Landing spider 43 engages landing ledge 41A and there is a clearance gap 47 between landing spider 40 and landing ledge 41. Electronics package 22 is compressed between landing ledges 41 and 41A by nut 44 until clearance gap 47 is taken up. In this embodiment, electronics package 22 has a fixed rotational orientation relative to section 26 held primarily by friction resulting from compression by nut 44 (and, in some cases augmented by thermal expansion of electronics package 22 within section 26).

Maintaining electronics package 22 under compression within bore 27 of section 26 may shift the natural resonant frequency of electronics package 22. This may in turn reduce the ability of the low-frequency vibrations typical in downhole locations from being able to excite resonant vibration of electronics package 22. This may result in reduced vibration of electronics package 22 and increased longevity of electronics package 22 under downhole conditions.

Maintaining electronics package 22 under compression may also prevent or reduce potential damage to couplings which may be provided to couple together different parts of the body of electronics package 22 as well as potential harm to electronics package 22 that could result from those couplings becoming loose while the electronics package is downhole.

Since the structures described herein may assist in holding such couplings together, couplings used to hold together different parts of electronics package 22 may be made much easier to uncouple than might otherwise be necessary. Many current probes are made in sections that are coupled by threaded couplings that require very high torques to assemble or disassemble (e.g. torques of 400 to 800 foot pounds). Such large torques make assembling, disassembling and maintaining such probes hard work and even potentially dangerous. Couplings in electronics package 22 may be held together by limiting axial elongation of an electronics package 22 or other probe. Consequently, extreme torques are not required to overcome the tendency of threaded couplings to come loose under vibration. By way of non-limiting example, the torque required to join the parts of the housing for electronics package 22 may be less than 100 foot pounds in some embodiments (e.g. in the range of 20-50 foot-pounds). Of course, larger torques may also be used.

In some applications, as drilling progresses, the outer diameter of components of the drill string may change. For example, a well bore may be stepped such that the wellbore is larger in diameter near the surface than it is in its deeper portions. At different stages of drilling a single hole, it may be desirable to install the same electronics package in drill string sections having different dimensions. Landing spiders having any of the features as described herein (e.g. including keys or other non-rotational coupling features) may be made in different sizes to support an electronics package within bores of different sizes. Landing spiders having any of the features as described herein may be provided at a well site in a set comprising landing spiders, nuts and/or keying features of a plurality of different sizes.

Moving a downhole probe or other electronics package into a drill string section of a different size may be easily performed at a well site by removing the electronics package from one drill string section, changing a spider or other longitudinal holding device to a size appropriate for the new drill string section and inserting the electronics package in the new drill string section.

Figure 7A:
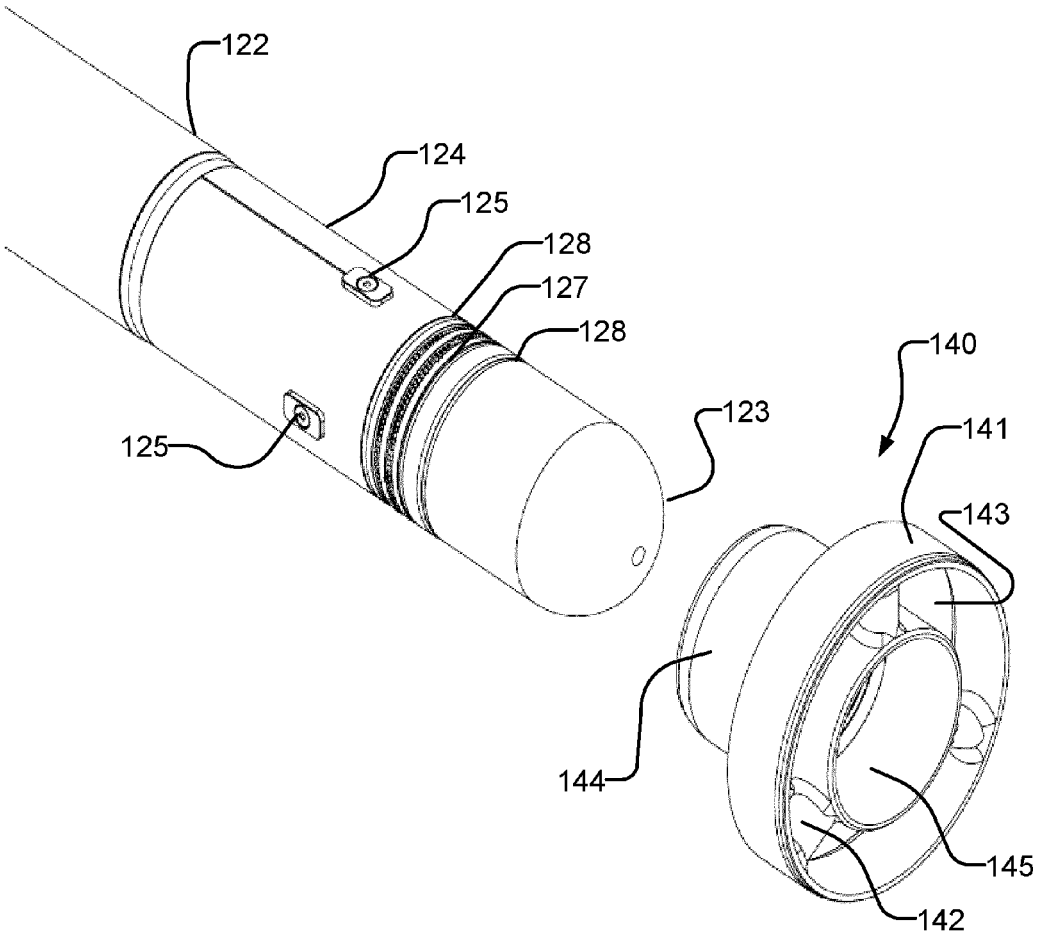
FIGS. 7A, 7B and 7C are respectively: a perspective view of a spider and a probe end configured to engage with the spider, a perspective view of a probe end engaged with a spider, and a cross sectional view of an end of a probe engaged with a spider according to an alternative embodiment.
Figure 7B:
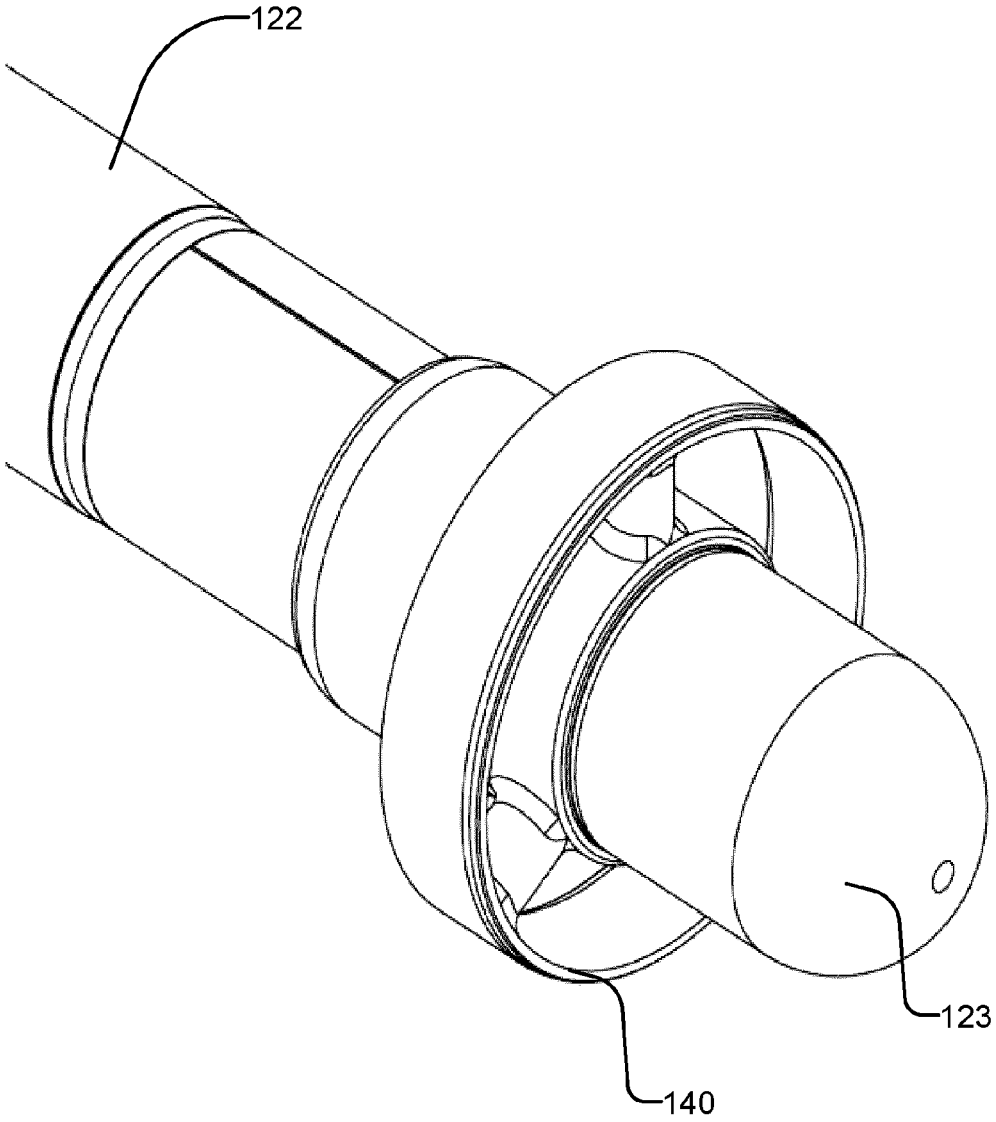
Figure 7C:
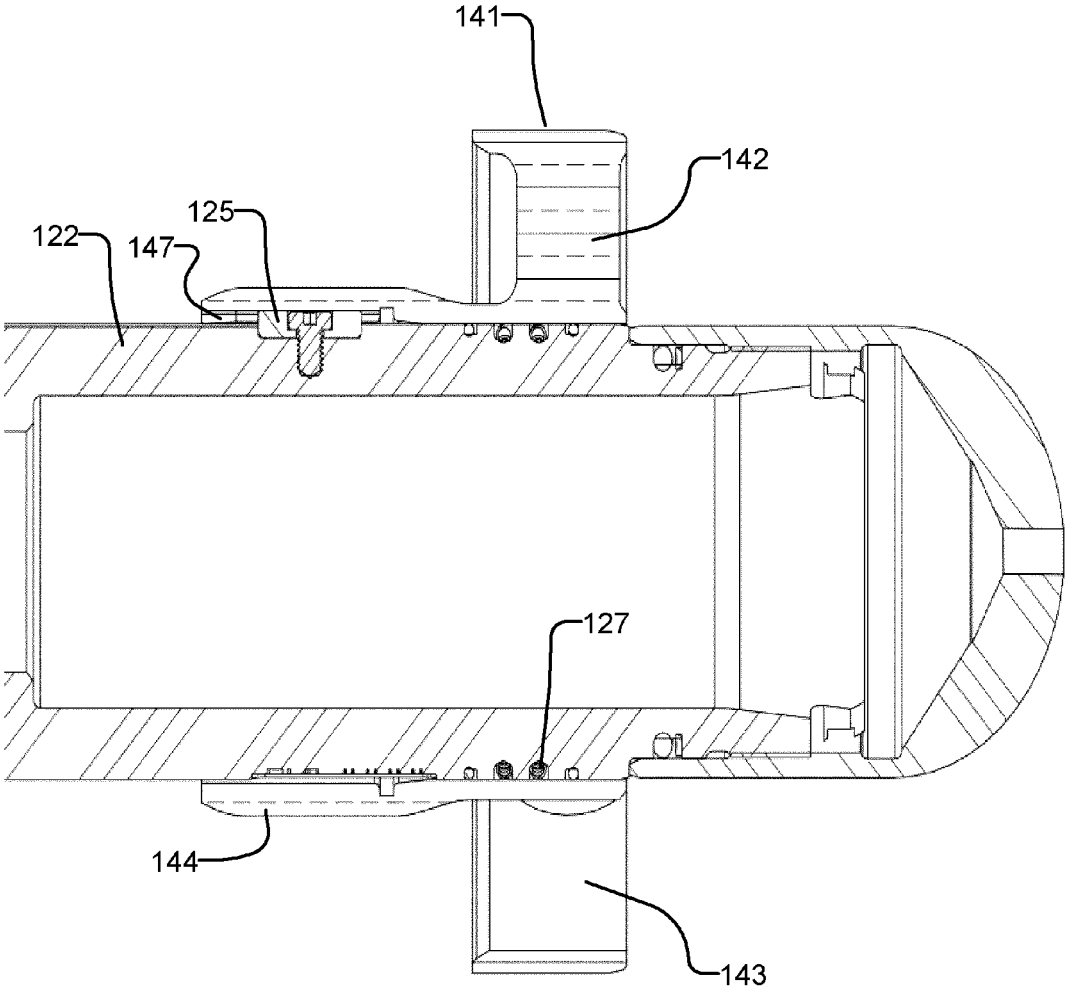

FIGS. 7A, 7B and 7C illustrate another example embodiment in which a probe is supported at one end by a spider that is attached to a section of drill string. For example, the spider may be press fit into a bore of the section of drill string. The probe may have any desired functionality. For example, the probe may offer functionality as described above for electronics package 22. The other end of the probe may be supported in the drill string in any suitable manner including those described above. The other end of the probe may be supported in a manner that supports the other end against axial motion relative to the drill string.

As shown in FIG. 7A, probe 122 has an end 123 that can be slidably inserted into a spider 140. Spider 140 can be attached to a section of drill string (not shown in FIG. 7A) for example, by press-fitting into the bore of the drill string. In some embodiments, spider 140 is press-fit into a counter bore at one end of the section of drill string.

Spider 140 comprises a ring 141 connected to a hub comprising a sleeve 144 by a number of spokes 142. Gaps 143 between spokes 142 permit the flow of drilling fluid past spider 140. End 123 of probe 122 is dimensioned to be slidably received in a bore 145 of sleeve 144. In use, end 123 may float axially in bore 145.

In a preferred embodiment, probe 122 and is configured to be non-rotationally received in spider 140. In preferred embodiments probe 122 can be received in spider 140 in only one rotational orientation. In such preferred embodiments, when probe 122 is engaged with spider 140, any sensors inside probe 122 that have a known orientation relative to probe 122 will also have a known orientation to spider 140. Since spider 140 is attached to a section of drill string, the sensors will also have a known orientation to the section of drill string. The drill string may be marked with indicia (which may include any feature identifying an angular position around the circumference of the section of drill string). The indicia provide a reference orientation. Probe 122 may be removed from the section of drill string and replaced into the section of drill string without changing the orientation of the sensors relative to the section of drill string.

In the illustrated embodiment one or more keys 125 on probe 122 engage keyways 147 in sleeve 144 (see FIG. 7C) to prevent rotation of probe 122 relative to spider 140. In the illustrated embodiment, a plurality of keys 125 are provided on the outer surface of probe 122. These keys are spaced apart angularly by a spacing matching an angular spacing of keyways 147. The angular spacing of keys 125 and keyways 147 is selected such that probe 122 can be fully inserted into bore 145 of spider 140 in only one rotational orientation.

Spider 140 may serve as an electrical contact for probe 122. For example, spider 140 may ground certain electrical components in probe 122 to the drill string section and/or serve as one terminal for connecting electromagnetic telemetry signals to the drill string section. To enhance electrical connectivity between probe 122 and spider 140 electrically conductive spring terminals 127 (which may comprise, for example, canted coil springs) are provided on probe 122. The spring terminals may extend circumferentially around the end 123 of probe 122. Thus, probe 122 is maintained in good electrical contact with spider 140 (even in the presence of severe vibration as occurs in the downhole environment during drilling) and spider 140 is in good electrical contact with the section of drill string into which spider 140 is attached. Spider 140 may be made of a suitable electrically conductive material such as, for example, a beryllium copper alloy.

Seals 128 (such as O-rings) may be provided on either side of spring terminals 127 to prevent ingress of drilling fluid into the area of spring terminals 127.

A plurality of spiders 140 may be made to fit a given probe 122 with rings 141 of different outside diameters. These different spiders may be attached inside drill string sections having different internal diameters. After this has been done, the probe 122 may be used without modification of end 123 in any of the different drill string sections.

Embodiments as described above may provide one or more of the following advantages. The locking feature presented, for example, by key 45 restricts rotation of electronics package 22 within bore 27 relative to section 26. The locking feature presented by nut 44 tightly clamping against uphole landing spider 40 restricts axial movement of electronics package 22 within section 26. The dual locking features provide proper alignment of internal and external features, which aid the operator in overall determination of drilling operations. The dual locking features also reduce vibration and rotational acceleration of electronics package 22 within section 26, which increases the reliability of electronics package 22 during drilling operations.

The confinement of axial movement of electronics package 22 prevents subsections of the housing of electronics package 22 from unthreading from one another thus making it unnecessary to make couplings connecting the subsections extremely tight. Restricting axial movement of electronics package 22 by applying compression on spider 41 using nut 44 reduces the need to use high torque to thread subsections of the body of the housing of electronics package 22, which may reduce maintenance costs as well as allow electronics package to be easily retrieved from drill strings without causing damage to its components.

In some embodiments spiders or other supports are electrically conductive and serve to conduct electrical signals from electronics package 22 to section 26. Spiders 40 and 43 may, for example, be conducted to output terminals of an electromagnetic telemetry signal generator. In such embodiments section 26 may comprise a gap sub having two electrically conductive parts that are electrically insulated from one another. Each spider may make an electrical connection to one of the conductive parts of the gap sub.

Apparatus as described herein may be applied in a wide range of subsurface drilling applications. For example, the apparatus may be applied to support downhole electronics that provide telemetry in logging while drilling ('LWD') and/or measuring while drilling ('MWD') telemetry applications. The described apparatus is not limited to use in these contexts, however.

One example application of apparatus as described herein is directional drilling. In directional drilling the section of a drill string containing a downhole probe may be non-vertical. The dual locking features as described herein can protect the downhole probe in the drill string and maintain sensors in the downhole probe centralized in the drill string. Furthermore, locking an electronics package 22 or other probe to have a fixed angle within a section 26 facilitates keeping the electronics package in a fixed rotational alignment to a bent sub or other directional drilling adaptation.

Supporting an electronics package 22 or other downhole probe at both ends, particularly where one end is keyed or otherwise locked against rotation relative to the drill string section in which it is mounted helps to reduce or eliminate twisting and rotation of the downhole probe under downhole conditions which can cause torsional accelerations of the downhole electronics package. Preventing the downhole probe from twisting and rotating can significantly increase the accuracy of measurements made during the drilling process by keeping sensors in a fixed angular orientation relative to the drill string section and to the high side of a bent sub or other directional drilling adaptation, where present.

Features of the above-described embodiments may be combined in various ways to yield other embodiments. In some embodiments an electronics package or other probe is both axially compressed between two spiders or other axial supports and prevented from rotation by a non-rotational interfacing of the electronics package to one or more axial supports and a non-rotational interfacing of one or more of the axial supports to a drill string section within which the electronics package is mounted. This is illustrated, for example, in FIG. 5

INTERPRETATION OF TERMS

Unless the context clearly requires otherwise, throughout the description and the

- "comprise," "comprising," and the like are to be construed in an inclusive sense, as opposed to an exclusive or exhaustive sense; that is to say, in the sense of "including, but not limited to".
- "connected," "coupled," or any variant thereof, means any connection or coupling, either direct or indirect, between two or more elements; the coupling or connection between the elements can be physical, logical, or a combination thereof.
- "herein," "above," "below," and words of similar import, when used to describe this specification shall refer to this specification as a whole and not to any particular portions of this specification.
- "or," in reference to a list of two or more items, covers all of the following interpretations of the word: any of the items in the list, all of the items in the list, and any combination of the items in the list.
- the singular forms "a", "an" and "the" also include the meaning of any appropriate plural forms.

Words that indicate directions such as "vertical", "transverse", "horizontal", "upward", "downward", "forward", "backward", "inward", "outward", "left", "right", "front", "back", "top", "bottom", "below", "above", "under", and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Where a component (e.g. a circuit, module, assembly, device, drill string component, drill rig system etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of systems, methods and apparatus have been described herein for purposes of illustration. These are only examples. The technology provided herein can be applied to systems other than the example systems described above. Many alterations, modifications, additions, omissions and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions and sub-combinations as may reasonably be inferred. The scope of the claims should not be limited by the preferred embodiments set forth in the examples, but should be given the broadest interpretation consistent with the description as a whole.

What is claimed is:

1. A downhole assembly comprising:

a drill string section having a bore extending longitudinally through the drill string section;

a downhole probe located in the bore of the section; the probe supported in the bore by first and second spiders at respective first and second locations spaced apart longitudinally within the bore; and a resilient electrical contact in a bore of the second spider and in electrical contact with both the second spider and the probe;

wherein the first and second spiders each comprise a hub connected to the downhole probe and a rim connected to the hub by a plurality of spokes, the rim of each of the spiders dimensioned to be received in the bore of the drill string section at the corresponding one of the first and second locations;

the first spider is fixed axially in the bore and a first end of the probe is fixed axially to the first spider and a second end of the probe is supported by the second spider in a manner that allows the second end of the probe to float axially relative to the bore; and the second spider is attached to the drill string section and the probe is slidably received in a bore in the hub of the second spider.

2. A downhole assembly according to claim 1 wherein both of the first and second spiders are fixed axially in the bore.

3. A downhole assembly according to claim 2 wherein the section comprises a first landing adjacent an uphole end of the probe and second landing adjacent a downhole end of the probe, the first spider is configured to engage the first landing and the second spider is configured to engage the second landing.

4. A downhole assembly according to claim 3 wherein the rim of the first spider abuts the first landing.

5. A downhole assembly according to claim 4 comprising a clamp forcing the rim of the first spider toward the first landing.

6. A downhole assembly according to claim 5 wherein the clamp compresses against the first spider reducing a gap between the first spider and the first landing.

7. A downhole assembly according to claim 5 wherein the clamp compresses against the first spider causing the first spider to engage the first landing.

8. A downhole assembly according to claim 5 wherein a longitudinal distance between the first and second landings is less than a longitudinal distance between edges of the rims of the first and second spiders that engage the first and second landings by a clearance distance and the clamp holds the probe in compression.

9. A downhole assembly according to claim 8 wherein the clearance distance is in the range of 0.010 to 0.020 inches.

10. A downhole assembly according to claim 8 wherein the probe comprises a compliant material.

11. A downhole assembly according to claim 10 wherein the compliant material comprises one or more compressible washers.

12. A downhole assembly according to claim 10 wherein the compliant material comprises a single-use crushable structure.

13. A downhole assembly according to claim 10 wherein the first spider and second spiders are resiliently deformable.

14. A downhole assembly according to claim 8 comprising a compliant material between the first spider and the first landing or between the second spider and the second landing or between both the first spider and the first landing and the second spider and the second landing.

15. A downhole assembly according to claim 8 comprising a compliant material between the first spider and the first landing.

16. A downhole assembly according to claim 8 comprising a compliant material between the second spider and the second landing.

17. A downhole assembly according to claim 1 wherein the probe undergoes thermal expansion upon exposure to downhole conditions.

18. A downhole assembly according to claim 17 wherein the probe thermally expands in length by 0.001 to 0.150 inches when the probe is moved from surface conditions to downhole conditions.

19. A downhole assembly according to claim 1 wherein the second spider is press-fit into the drill string section.

20. A downhole assembly according to claim 1 wherein the resilient electrical contact extends circumferentially around the probe.

21. A downhole assembly according to claim 20 wherein the resilient electrical contact comprises a canted coil spring.

22. A downhole assembly according to claim 1 comprising first and second seals in the bore of the second spider on either side of the resilient electrical contact.

23. A downhole assembly according to claim 1 wherein the probe is non-rotationally engaged in the bore of the second spider.

24. A downhole assembly according to claim 23 comprising one or more keys on the probe engaged with one or more corresponding keyways in the bore of the second spider.

25. A downhole assembly according to claim 1 wherein the probe is non-rotationally engaged with the second spider and the second spider is non-rotationally engaged with the drillstring section.

26. A downhole assembly according to claim 1 wherein the hub of the first spider comprises a bore and the downhole probe comprises a shaft portion engaged in the bore of the hub of the first spider.

27. A downhole assembly according to claim 26 comprising a fastener on the probe configured to clamp the first spider against a shoulder on the probe.

28. A downhole assembly according to claim 26 wherein the shaft portion is non-rotationally engaged with the hub of the first spider.

29. A downhole assembly according to claim 26 wherein the second spider is non-rotationally engaged with the probe.

30. A downhole assembly according to claim 28 wherein the shaft portion is splined or keyed to the bore of the first spider.

31. A downhole assembly according to claim 1 wherein the rim of the first spider abuts a first landing in a wall of the bore.

32. A downhole assembly according to claim 31 comprising a clamp forcing the first spider against the first landing.

33. A downhole assembly according to claim 32 wherein the clamp comprises an externally-threaded ring engaging internal threads within the bore.

34. A downhole assembly according to claim 1 wherein at least one of the first and second spiders is coupled non-rotationally to both the probe and the drill string section.

35. A downhole assembly according to claim 1 comprising an anti-rotation mechanism comprising at least one key member coupled to the probe, the at least one key member engaging a corresponding at least one key channel in the bore of the section.

36. A downhole assembly according to claim 35 wherein the at least one key member is on the second spider.

37. A downhole assembly according to claim 1 comprising a centralizer on the probe between the first and second locations.

38. A downhole assembly according to claim 1 wherein the downhole probe comprises an electronics package.

39. A downhole assembly according to claim 1 wherein the downhole probe comprises a cylindrical housing.

40. A downhole assembly according to claim 39 wherein the downhole probe has a length in the range of 1 to 20 meters.

41. A downhole assembly comprising:

a drill string section having a bore extending longitudinally through the drill string section;

a downhole probe located in the bore of the section; the probe supported in the bore by first and second spiders at respective first and second locations spaced apart longitudinally within the bore wherein the section comprises a first landing adjacent an uphole end of the probe and second landing adjacent a downhole end of the probe, the first spider is configured to engage the first landing and the second spider is configured to engage the second landing, at least one of the first and second spiders fixed axially in the bore; and a clamp forcing the rim of the first spider toward the first landing;

the clamp compressing against the first spider reducing a gap between the first spider and the first landing so that the rim of the first spider abuts the first landing;

wherein the first and second spiders each comprise a hub connected to the downhole probe and a rim connected to the hub by a plurality of spokes, the rim of each of the spiders dimensioned to be received in the bore of the drill string section at the corresponding one of the first and second locations;

a longitudinal distance between the first and second landings is less than a longitudinal distance between edges of the rims of the first and second spiders that engage the first and second landings by a clearance distance and the clamp holds the probe in compression;

the probe comprises a compliant material; and the arms of at least one of the first and second spiders are resiliently deformable by the clearance distance.

42. A downhole assembly comprising:

a drill string section having a bore extending longitudinally through the drill string section;

a downhole probe located in the bore of the section; the probe supported in the bore by first and second spiders at respective first and second locations spaced apart longitudinally within the bore, at least one of the first and second spiders fixed axially in the bore; and a fastener on the probe configured to clamp the first spider against a shoulder on the probe;

wherein:

the first and second spiders each comprise a hub connected to the downhole probe and a rim connected to the hub by a plurality of spokes, the rim of each of the spiders dimensioned to be received in the bore of the drill string section at the corresponding one of the first and second locations;

the hub of the first spider comprises a bore and the downhole probe comprises a shaft portion engaged in the bore of the hub of the first spider; and the fastener comprises an acorn nut.

43. A downhole assembly comprising:

a drill string section having a bore extending longitudinally through the drill string section;

a downhole probe located in the bore of the section; the probe supported in the bore by first and second spiders at respective first and second locations spaced apart longitudinally within the bore, at least one of the first and second spiders fixed axially in the bore;

wherein the first and second spiders each comprise a hub connected to the downhole probe and a rim connected to the hub by a plurality of spokes, the rim of each of the spiders dimensioned to be received in the bore of the drill string section at the corresponding one of the first and second locations;

the downhole probe comprises an electronics package; and the downhole probe comprises a housing having first and second sections that are electrically insulated from one another, the first and second spiders are electrically conducting and are respectively coupled to the first and second sections of the housing, the electronics package comprises an EM telemetry transmitter having first and second terminals respectively electrically connected to the first and second sections of the housing and the first and second locations are in parts of the drill string section that are electrically insulated from one another.

* * * * *